US005406824A

United States Patent [19]

Toda et al.

[11] Patent Number: 5,406,824

[45] Date of Patent: Apr. 18, 1995

[54] PROCESS OF HOT FORGING AT ULTRAHIGH TEMPERATURE

[75] Inventors: Masahiro Toda; Takeshi Miki; Osamu Kada, all of Futtsu, Japan

[73] Assignee: Nippon Steel Corporation, Tokyo, Japan

[21] Appl. No.: 111,249

[22] Filed: Aug. 24, 1993

[30] Foreign Application Priority Data

Sep. 17, 1992 [JP] Japan ..... 4-272464
Sep. 17, 1992 [JP] Japan ..... 4-272465

[51] Int. Cl.[6] ..... B21J 1/06
[52] U.S. Cl. ..... 72/342.94; 72/364
[58] Field of Search ..... 72/342.5, 342.6, 342.94, 72/364

[56] References Cited

U.S. PATENT DOCUMENTS 4,479,833 10/1984 Gessinger et al. .
4,617,067 10/1986 Gueussier .
5,257,522 11/1993 Miki et al. ..... 72/342.5

FOREIGN PATENT DOCUMENTS 0522501 1/1993 European Pat. Off. .
118135 4/1992 Japan ..... 72/364
2094196 9/1982 United Kingdom .
818717 4/1981 U.S.S.R. ..... 72/364
871961 10/1981 U.S.S.R. ..... 72/364

OTHER PUBLICATIONS

K. P. Young et al., "Structure and properties of Thixocast Steels", Metals Thechnology, Apr. 1979, pp. 130–137.

J-J. A. Cheng et al., "Processing-Structure Characterization of Rheocast IN-100 Superally", Metallurgical Transactions A, vol. 17A, pp. 2049–2062.

H. Lehuy et al., "Rheological behavior and microstructure of stir-casting zinc-aluminium alloys", J. of Materials Science, 20 (1985) 105–113.

Kobe Steel Engineering Reports, vol. 21, No. 3, 1971, pp. 57–61.

Seisan Kenkya, vol. 42, No. 2, 1990, pp. 11–14.

Patent Abstracts of Japan, vol. 9, No. 111, (M-379)(1834) May 15, 1985 & JP-A-59 232 641 (Shin Nippon Seitetsu KK) Dec. 27, 1984 abstract.

*Primary Examiner*—Lowell A. Larson
*Attorney, Agent, or Firm*—Kenyon & Kenyon

[57] ABSTRACT

A process of hot forging a steel at an ultrahigh temperature, including the steps of: heating a steel containing 0.1 wt % or more and less than 1 wt % carbon, in a non-oxidizing gas atmosphere, at a heating rate of from 3° to 20° C./sec, in a differential manner such that the steel shell having a thickness of from 0.5 mm to 1/5 of a maximum diameter of the steel is heated to a temperature within a range from a higher value selected from a temperature 45° C. below a solidus line and a temperature of 1250° C. to a temperature 20° C. below a liquidus line while the steel core is heated to a temperature 20° C. below the liquidus line or higher; blowing a cooling medium onto the surface of the heated steel to remove an oxide film from the steel furnace while cooling the steel shell having a thickness of from 1 mm to 1/5 of the maximum diameter of the steel, at a high cooling rate of 10° C./sec or more to a hot forging temperature of 1200° C. or lower; and hot forging the steel, after the blowing, either in a die at a working speed of 500 mm/sec or more or in a die preheated to a temperature of 200° C. of higher at a working speed of 200 mm/sec or more.

10 Claims, 4 Drawing Sheets

Dk : SHELL THICKNESS
Do : MAXIMUM DIAMETER

PROCESS OF HOT FORGING AT ULTRAHIGH TEMPERATURE

BACKGROUND OF THE INVENTION

1. Field of the Invention

The present invention relates to a process of forging a steel, particularly steel articles having a complicated shape such as connecting rods and other load bearing parts used for the suspension assembly of automobiles and construction equipment.

2. Description of the Related Art

The conventional processes for producing machine parts by forging steel include hot forging, warm forging, and cold forging. Small articles having a simple shape are produced by cold forging and large articles having a complicated shape are produced by hot forging. Warm forging is particularly used for the high precision forming of stainless steel and other materials having a high resistance to deformation.

The recent trend of minimizing the weight of machine parts including those of automobiles necessitates steel materials with greater strength achieved by the addition of alloying elements in steel, resulting in an increased resistance to deformation which a forging tool cannot withstand. Moreover, a section modulus compensating for a reduction in stiffness due to weight reduction requires a complicated article shape causing a further reduction in the life of the forging tools used for forming thereof.

To solve this problem, it might be possible to reduce the resistance to deformation by using an elevated forging temperature higher than the conventional temperature of from 1000° to 1250° C., or it might be also possible to form a steel article directly from a molten state.

Forging a steel at such high temperatures, however, is not practically advantageous and is not actually done, because the elevated temperature causes an intense oxidation of steel during heating and forging thereof with a resulting degradation in product yield, article precision, and surface quality and because the formability of steel is not remarkably improved as expected due to a rapid drop of the material temperature when brought into contact with a forging die.

Such an elevated temperature forging is only reported on page 11 of "SEISAN-KENKYU (Study of Manufacture)", Feb. 1990, vol. 42, No. 2, page 11 published by the Institute of Industrial Science, University of Tokyo, in which a cast iron is heated to a half-molten state and forged. The half-molten state enables a material which is otherwise unforgeable to be forged without the occurrence of cracking. A cast iron can be brought into a half-molten state by heating to about 1000° C., which is not higher than a normal temperature used in the forging of steels, and no particular measures are taken to control the heating condition and atmosphere for suppressing the oxidation and the working condition for improving the formability.

Steels have a melting point far higher than that of cast irons and are not forged at a temperature close to the melting point thereof because of the above-mentioned problems.

Cast irons are, of course, not applicable as a material for strength parts or load bearing parts necessary for automobiles, etc.

The "forging cast process" produces machine parts directly from a molten metal and is applied to the production of a suspension assembly of automobiles and other parts such as pistons as described in Kobe Steel Engineering Report, vol. 21, No. 3, page 57. Problems occur, however, in that the direct introduction of molten metal into a mold causes the molten metal to adhere to the mold wall thereby affecting the parting of products from the mold as well as the mold life.

SUMMARY OF THE INVENTION

The object of the present invention is to provide a process of forging a steel, the process being advantageously applicable when producing high strength, light weight machine parts, in which an ultrahigh temperature is used while ensuring good tool life and product precision.

To achieve the object according to the first aspect of the present invention, there is provided a process of hot forging a steel at an ultrahigh temperature, comprising the steps of:

heating a steel containing 0.1 wt % or more and less than 1 wt % carbon and having a surface, in an atmosphere substantially composed of a non-oxidizing gas, at a heating rate of from 3° to 20° C./sec in terms of a rate of temperature rise in the steel surface, in a differential manner such that a shell portion of the steel, defined by the steel surface and a depth from the steel surface within a range of from 0.5 mm to 1/5 of a maximum diameter of the steel, is heated to a temperature within a range having a lower limit defined by a higher value selected from a temperature 45° C. below a solidus line in an equilibrium phase diagram of the steel and a temperature of 1250° C. and an upper limit defined by a temperature 20° C. below a liquidus line in the diagram while a core portion enclosed by the shell portion is heated to a temperature 20° C. below the liquidus line or higher;

blowing a cooling medium onto the surface of the heated steel thereby removing an oxide film from the steel surface while cooling a shell portion of the steel, defined by the steel surface and a depth from the steel surface within a range of from 1 mm to 1/5 of the maximum diameter of the steel, at a high cooling rate of 10° C./sec or more to a hot forging temperature of 1200° C. or lower; and hot forging the steel, after the blowing, either in a die at a working speed of 500 mm/sec or more or in a die preheated to a temperature of 200° C. or higher at a working speed of 200 mm/sec.

According to the second aspect of the present invention, there is provided a process of hot forging a steel at an ultrahigh temperature, comprising the steps of:

heating a steel containing 0.1 wt % or more and less than 1 wt % carbon and having a surface, in an atmosphere substantially composed of a non-oxidizing gas, at a heating rate of from 3° to 20° C./sec in terms of a rate of temperature rise in the steel surface, in a differential manner such that a shell portion of the steel, defined by the steel surface and a depth from the steel surface within a range of from 0.5 mm to 1/5 of a maximum diameter of the steel, is heated to a temperature within a range having a lower limit defined by a higher value selected from a temperature 45° C. below a solidus line in an equilibrium phase diagram of the steel and a temperature of 1250° C. and an upper limit defined by a temperature 20° C. below a liquidus line in the diagram while a core portion enclosed by the shell portion is heated to a temperature 20° C. below the liquidus line or higher; and hot forging the heated steel either in a die at a working speed of 500 mm/sec or more or in a die preheated to a temperature of 200° C. or higher at a working speed of 200 mm/sec.

The present invention makes it possible to forge a high strength steel under a reduced resistance to deformation and thereby ensures long tool life and good precision of the forged product, by using a differential heating such that the steel core is heated to a molten or half-molten state while the steel shell is heated to such an ultrahigh temperature that was not conventionally applicable.

DESCRIPTION OF THE PREFERRED EMBODIMENTS

Figure 1:
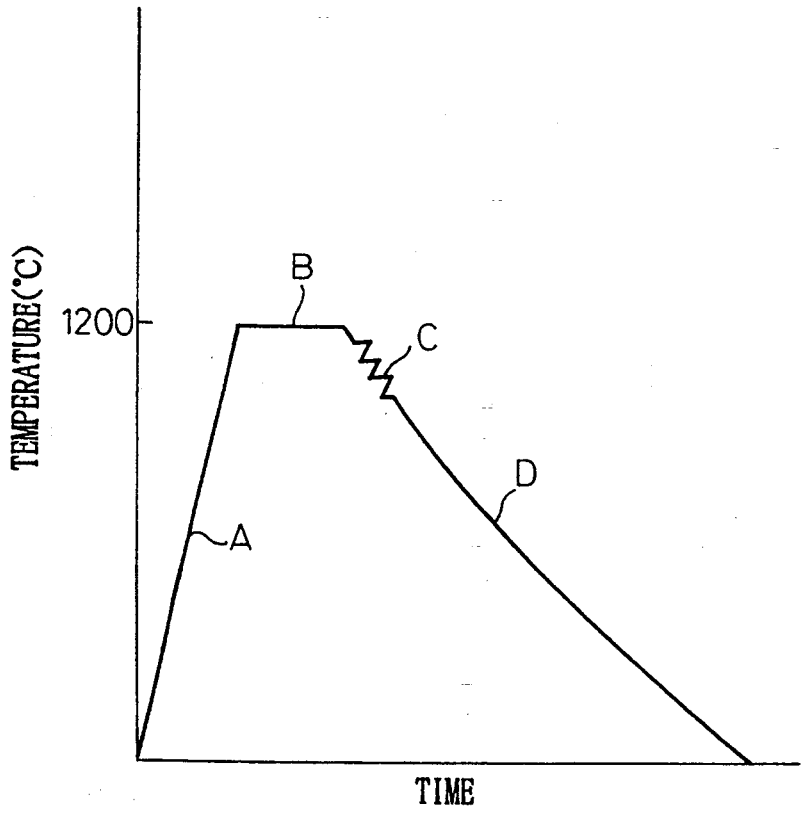
Fig.1 PRIOR ART
FIG. 1 is a graph showing a time-temperature curve used in forging a steel by a conventional process.

FIG. 1 shows a typical time-temperature curve used in a conventional forging process, in which a steel is heated in step "A" usually to a temperature of about 1200° C. where it is held in step "B" to equalize the temperature throughout the steel volume, then forged in step "C" and naturally cooled in step "D" to an ambient temperature.

Figure 2:
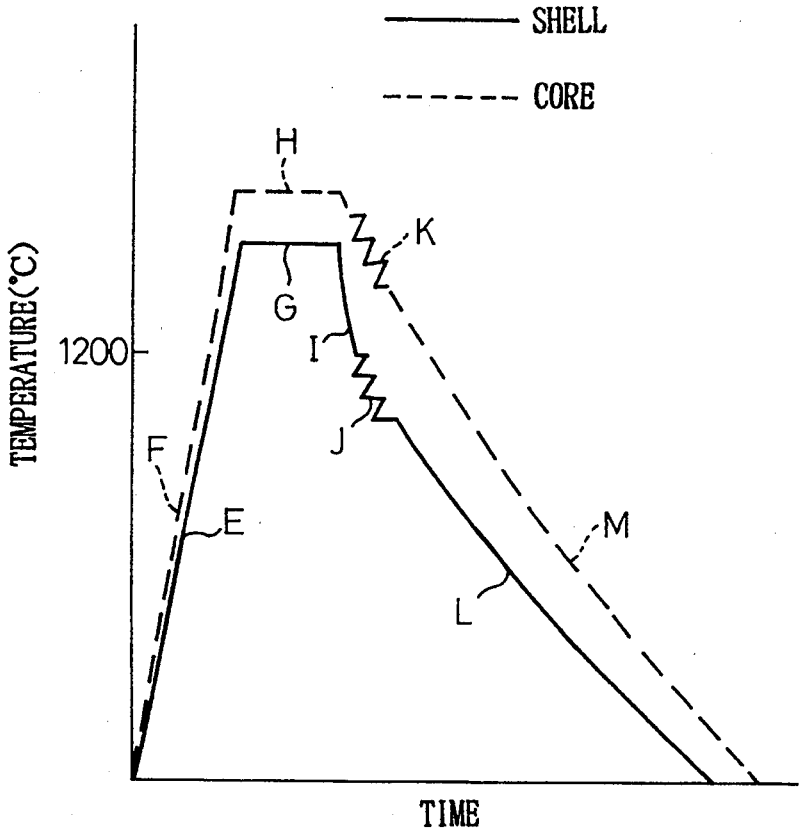
FIG. 2 is a graph showing a pair of time-temperature curves used in forging a steel by a process according to the first aspect of the present invention.

FIG. 2 shows a pair of time-temperature curves used in a forging process according to the first aspect of the present invention, in which the solid and broken lines represent the time-temperature curves for shell and core portions of the steel, respectively. When the steel is in the form of a short round bar as usually used for forging, for example, the shell and core portions of the steel are defined as a hollow cylindrical case and an inner volume enclosed by the shell, respectively.

In the heating step according to the present invention, the shell is more strictly referred to as a case having a thickness defined by the steel surface and a depth from the steel surface within a range of from 0.5 mm to 1/5 of a maximum diameter of the steel.

The steel is heated so that the shell and core are heated in the following differential manner.

The shell is rapidly heated in step "E" to an ultrahigh temperature where it is held for a short time in step "G", then rapidly cooled in step "I" to a hot forging temperature of not higher than 1200° C., forged at a high working speed in step "J", and cooled in step "L"to an ambient temperature.

At the same time, the core is rapidly heated in step "F" to a higher temperature than the shell, i.e., to a molten or half-molten state, held there in step "H", forged in step "K", and cooled in step "M" to an ambient temperature.

Note that the steel shell is rapidly cooled in step "I" prior to forging without causing the core to be substantially cooled.

The cooling step ("L", "M") after forging is not essential in the present invention. The forged product may be subjected to stress-relief annealing or other optional treatments in accordance with need, before being finally cooled to an ambient temperature.

Figure 3:
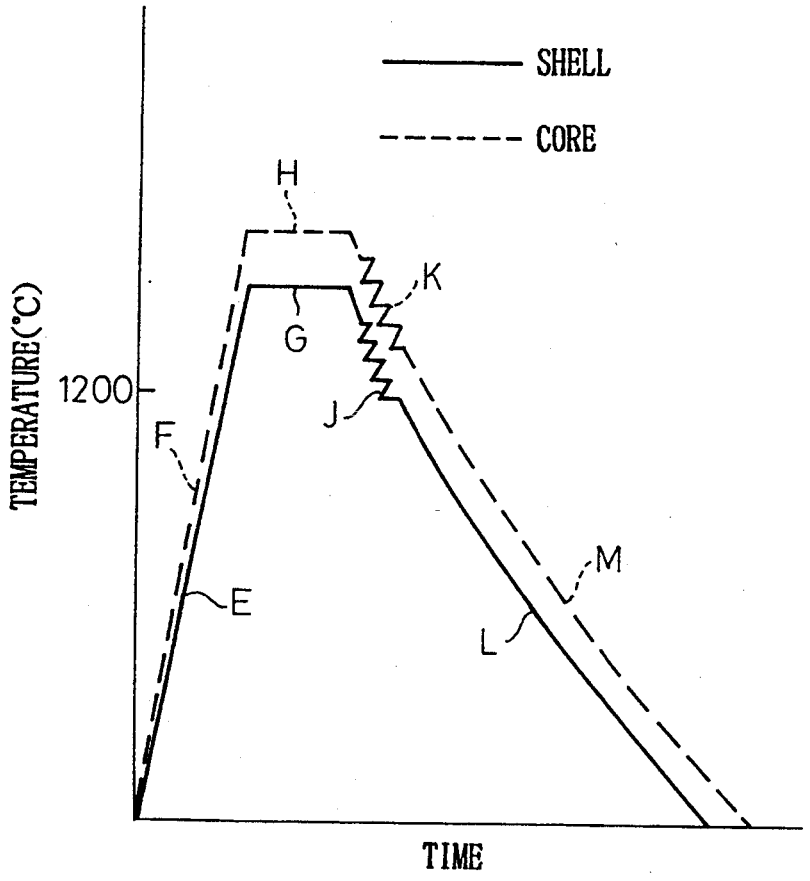
FIG. 3 is a graph showing a pair of time-temperature curves used in forging a steel by a process according to the second aspect of the present invention.

FIG. 3 shows a pair of time-temperature curves used in a forging process according to the second aspect of the present invention, in which the solid and broken lines represent the time-temperature curves for shell and core portions of the steel, respectively.

The curves are only different from those of FIG. 2 in that the shell, as well as the core, is not subjected to a rapid cooling prior to forging.

The heating, holding, forging and cooling steps are denoted by the same symbols as those in FIG. 2, except for the cooling step "I" prior to forging.

Regarding the heating step, the shell is defined in the same sense as in the first aspect.

According to the present invention, the heating step "E" /"F" is carried out in an atmosphere substantially composed of a non-oxidizing gas, such as argon and nitrogen, at a heating rate of from 3° to 20° C./sec in terms of a rate of temperature rise in the steel surface, by means of induction heating or any other rapid heating techniques. In addition to the use of a non-oxidizing atmosphere, the high heating rate further minimizes the oxidation of a steel caused by unavoidably accompanying oxidizing impurities in the non-oxidizing atmosphere gas when heated to an ultrahigh temperature, and thereby, improves the product yield and precision. To this end, the heating rate must be 3° C./sec or more. The heating rate, however, must not be more than 20° C./sec to prevent the steel shell from breaking due to a partial melt-down of the steel material.

The short time holding step "G"/"H" is not essential, but is usually preferable to establish the temperatures of the shell and core portions within the specified ranges, respectively.

The heating rate may be referred to as an average heating rate.

The differential heating according to the present invention is effected in the following manner.

The steel shell is heated to a temperature within a range having a lower limit defined by a higher value selected from a temperature 45° C. below the solidus line in an equilibrium phase diagram of the steel and a temperature of 1250° C. and having an upper limit defined by a temperature 20° C. lower than a liquidus line in the same diagram. The lower limit ensures that the steel shell has a sufficiently small deformation resistance or good formability during the subsequent forging step. The upper limit ensures that any minute fluctuation in temperature over the steel shell does not cause a partial melt-down of the steel material.

At the same time, the steel core is heated to or above a temperature 20° C. below the liquidus line in an equilibrium phase diagram of the steel. This heating brings the steel core into a molten or half-molten state, so that the steel has an even smaller resistance to deformation or better formability than the steel shell during the subsequent forging step.

Thus, the differential heating of the present invention provides less resistance to deformation or better formability during forging than that obtained when the overall volume of the steel is heated to a temperature within the range such as that defined for the steel shell.

The differential heating is typically effected by a heat generation in the steel by electromagnetic induction heating and a simultaneous heat extraction through the steel surface by blowing a non-oxidizing gas onto the steel surface. The non-oxidizing gas ensures that the necessary non-oxidizing atmosphere is maintained during the heating step to prevent the oxidation of the steel surface.

The shell as defined for the heating step has a depth from the steel surface within the range of from 0.5 mm to 1/5 of the maximum diameter of the steel. The shell thickness must not be less than 0.5 mm to prevent the molten or half-molten steel core from penetrating the shell and flowing out to adhere to the mold wall. The shell thickness, on the other hand, must not be more than 1/5 of the maximum diameter of the steel to ensure the effect of the molten or half-molten core to reduce the deformation resistance.

Figure 4:
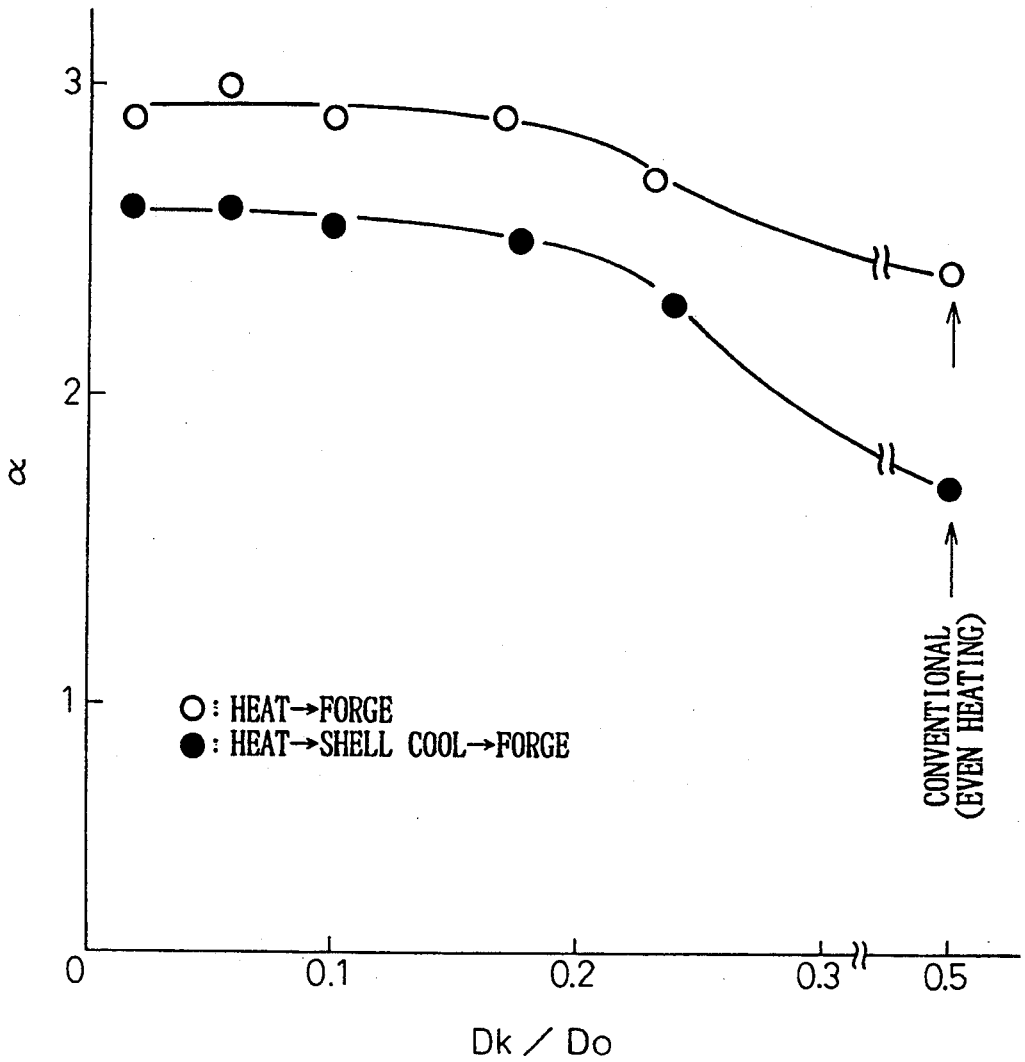
FIG. 4 is a graph showing the enlargement ratio of the sectional area as a function of the ratio $D_k/D_o$, where $D_k$ represents the shell thickness or depth from steel surface and $D_o$ represents the maximum steel diameter.

FIG. 4 shows the enlargement ratio ($\alpha$) of the steel sectional area as a function of the ratio of the shell thickness $D_k$ as defined for a heating step to the maximum diameter $D_o$. The enlargement ratio ($\alpha$) is defined as a ratio of the cross section of a forged or upset steel bar to the initial cross section of the bar before the forging. Solid and blank circles denote the $\alpha$ values obtained when the steel shell is rapidly cooled and not cooled before forging according to the first and second aspect of the present invention, respectively. In both cases, it can be seen from FIG. 4 that high $\alpha$ values are stably obtained when the $D_k/D_o$ ratio is 0.2 or less, i.e., when the shell thickness Dk is not more than 1/5 of the maximum diameter $D_o$. Note that the data plotted at the right end in FIG. 4 were obtained by the conventional process in which the steel is uniformly heated over the cross section, not in the differential manner of the present invention.

The data plotted in FIG. 4 were obtained by the following experiment. Two 30 mm in diameter and 40 mm long steel bars were heated together in an electromagnetic induction coil; one of the steel bars had thermocouples embedded therein for measuring temperatures at depths of 1, 2, 3, 5 and 7 mm from the bar circumferential surface and was not forged after heating; and the other had no thermocouple and was forged. A high frequency power applied to the coil was controlled to establish a desired core temperature at the center of the bar by using another thermocouple embedded in the center of the former bar. Specifically, regarding the respective plots in FIG. 4, the bar center was always heated to a core temperature of 1480° C. while nitrogen gas was blown onto the bar surface to extract heat from the bar at different blow amounts to establish a shell temperature of 1370° C. at the above-mentioned different depths of 1, 2, 3, 5 and 7 mm, which correspond to the five plots on the left hand portion of each of the curves in FIG. 4.

As used in the above experiment, the differential heating of the present invention may be carried out in the following manner. A dummy steel piece having thermocouple in the shell and core portions thereof and a real steel piece having no thermocouple are placed together in an induction coil and heated simultaneously. The induction power is controlled so that a desired temperature is established in the core of the dummy steel piece. A heat insulator such as a ceramic may be inserted between the dummy and real steel pieces when it is necessary to avoid possible adhesion between these steel pieces during heating. A substantially non-oxidizing gas is blown onto the both steel pieces to perform differential heating, during which the surface temperature of the real steel piece is monitored by a radiation thermometer to provide information of the difference between the measured surface temperatures of the dummy and real steel pieces. Such information serves as a basis for adjusting the gas blowing position and also as a basis for controlling the forging start temperature of the real steel piece in accordance with the expected temperature drop from the termination of heating to the start of forging.

The differential heating according to the present invention may be performed in another manner such as follows. The dummy steel piece is not used when the parameters of the induction heating and the heat extraction by blowing of a non-oxidizing gas are preliminarily determined for the shape of the steel piece to be forged. In this case, the induction heating is performed by using an induction heating pattern memorized in the induction heating apparatus so that a desired temperature is established in the core. The heat extraction through the steel surface by blowing of a non-oxidizing gas is controlled by adjusting the gas flow rate in compliance with the surface temperature preliminarily measured by experiment and the actual surface temperature monitored by a radiation thermometer. The thus-monitored surface temperature is also used as a basis for controlling the forging start temperature in accordance with the expected temperature drop from the termination of heating to the start of forging.

The solidus and liquidus lines are determined by using a published binary- or ternary-equilibrium phase diagram of Fe—X or Fe—X1—X2 system; the symbols "X", "X1" and "X2" denote major alloying elements of the steel concerned. The most accepted of the published phase diagram books is known as the "Binary Alloy Phase Diagram", M. Hansen, 1958, McGrow-Hill. The solidus and liquidus temperatures of a specific steel may be precisely corrected for minor elements by experiment, if necessary.

The steel to be advantageously forged by the present inventive process contains carbon in an amount of 0.1 wt % or more and less than 1 wt %. The carbon content must be 0.1 wt % or more to provide high strength. When the carbon content is 1 wt % or more, the forged product has too poor a toughness to be used as critical parts of automobiles and the like.

In the first aspect of the present invention, a shell portion for the steel is rapidly cooled before forging to refine the forged micro structure in the shell portion thereby improving the impact toughness of the forged product. The shell must be cooled to a hot forging temperature of 1200° C. or less to ensure this effect. The cooling rate must be 10° C./sec or more to prevent the oxidation of the steel surface. The shell in this respect is defined by the steel surface and a depth from the steel surface within the range of from 1 mm to 1/5 of the maximum diameter of the steel. The shell defined for rapid cooling before forging is hereinafter referred to as an "anteforge shell" to distinguish it from the shell formerly defined for heating.

The thickness of the anteforge shell must be 1 mm or more so that the refined micro structure of the anteforge shell provides a substantial improvement in the performance of the forged product. The thickness, however, must not be more than 1/5 of the maximum diameter of the steel, because a greater thickness increases the deformation resistance of the cooled shell, and thereby, lowers the plastic deformability of the overall steel volume.

The cooling medium to be blown onto the steel surface prior to forging may be a pressurized gas, such as air and nitrogen, or may contain a liquid medium, such as water, or a solid medium, such as shot grains.

The forging according to the present invention is carried out either at a working speed of 500 mm/sec or more in a forging die which is not preheated or at a working speed of 200 mm/sec or more in a die preheated to a temperature of 200° C. or higher. This high speed forging advantageously prevents the steel material from being cooled by the die and thereby avoids the resulting increase in deformation resistance and decrease in formability. When the forging die is preheated to 200° C. or higher, the cooling of the steel by the die is mitigated, so that the working speed of 200 mm/sec or more is sufficient to ensure the above effect.

A steel used in the present inventive process usually consists, in wt %, of:

C: 0.1 or more and less than 1.0,
Si: 0.1–1.5,
Mn: 0.15–2.0,
Ni: 3.5 or less,
Cr: 1.5 or less,
Mo: 0.5 or less, and
the balance consisting of iron and unavoidable impurities.

The carbon content must be within the above-specified range for the reasons already stated herein.

Silicon, when present in an amount of 0.1 wt % or more, serves as an essential deoxidizer in the steelmaking process and effectively improves the steel strength, but should not be present in an amount of more than 1.5 wt % to ensure good toughness.

Manganese, like silicon, is also effective for deoxidation and strengthening, but the manganese amount should be limited to not more than 2.0 wt % to ensure good toughness.

Nickel improves the toughness but no further improvement is obtained when contained in an amount of more than 3.5 wt %.

Chromium improves the strength but lowers the toughness when present in an amount of more than 1.5 wt %.

Molybdenum improves the toughness but no further improvement is obtained when contained in an amount of more than 0.5 wt %.

The present inventive process may advantageously further comprises the step of maintaining the forged steel at a lower dead point of a forging stroke under a load of 10% or more of a maximum load applied during the forging until the steel temperature, at least in the steel surface, is lowered to 1000° C. or lower. This load maintenance step advantageously prevents the precision of the forged product from being degraded because of large thermal distortion occurring when an ultrahigh temperature is completed in a very short time. When the steel temperature, at least in the surface layer, is lowered to 1000° C. or lower, a large thermal distortion does not occur. A load of 10% or more of a maximum forging load sufficiently suppresses thermal distortion.

The present inventive process may also advantageously further comprises the step of rapidly cooling the forged steel at a cooling rate of 5° C./sec or more until the steel, at least in the steel surface, is cooled to 800° C. or lower. Both the cooling rate of 5° C./sec or more and the cooling termination temperature of 800° C. or lower suppress a possible oxidation of the steel because of residual oxidizing impurities in the atmosphere of a non-oxidizing gas.

The present inventive process has a wide field of application and is typically applied to automobile parts including engine equipment such as crankshafts and connecting rods, shaft couplings, transmission parts, and suspension assemblies. Accordingly, the steel material to be forged by the present inventive process is generally provided in the form of a round bar having a diameter, for example, of from about 20 mm to about 120 mm, a square bar having a side width, for example, of up to 120 mm, or other bars or blocks having a similar size.

EXAMPLE 1

Experiments were carried out by using the steel samples A and B having the chemical compositions as stated in Table 1 both in a process according to the first aspect of the present invention and in a comparative process. Table 1 also shows the measured values of the solidus and liquidus temperatures of the sample steels.

30 mm in dia., 45 mm long steel samples were heated to and held at selected temperatures and forged by longitudinal compression at different working speeds with no lubrication. In a process according to the present invention, the samples were heated at different heating rates of from 3 to 20° C./sec by using a high frequency power supply in a nitrogen gas atmosphere.

To preliminarily determine the heating parameters necessary to ensure the desired differential heating, including the induction power and the flow rate of the nitrogen gas blown onto the sample surface, experimental heating was performed by using a dummy sample with thermocouples embedded therein in a depth of 1 mm and in the middle. The measured temperatures are cited in Table 2 as "Heating temperatures". The dummy samples were only used for this purpose and were not forged.

The real samples to be actually forged did not have thermocouples and were heated with the thus-predetermined heating parameters in accordance with the desired shell and core temperatures to be established.

In the comparative process, some samples were heated in air at a heating rate within the range of from 2° to 20° C./sec, and in this case, the sample temperatures were represented by the core temperature.

In both the inventive and comparative processes, the samples were forged by compression in the direction of the sample axis until a maximum load of 10 tonf was reached. The symbol "$\alpha$" denotes the area enlargement ratio, i.e., the ratio of the cross-sectional area of the axially compressed sample to the initial cross-sectional area before the forging.

Table 2 also shows the toughness of the samples in the shell portion rapidly cooled after forging, in terms of the JIS No. 4 impact value at 20° C. The right end column shows the oxide film thickness measured after the forging.

It is demonstrated by the results that the present inventive process ensures a remarkably improved formability, specifically all of the present inventive samples had an enlargement ratio greater than 2.5 whereas the comparative samples C5 to C7 and C9 to C12 had poor values less than about 2.0 in which the heating temperature, the working speed and the die preheating temperature were outside the specified range of the present invention.

It is also demonstrated that the present invention remarkably improves the toughness of the forged product, i.e., present inventive samples had an impact value greater than 10 kgf-m/cm$^2$ in contrast with the comparative samples C1, C3, C7, C8 and C13 in which the rapidly cooled shell had a thickness less than the specified lower limit of 1 mm and the comparative samples C2, C5 and Cll in which the shell portion was not rapidly cooled before forging.

Regarding the surface oxide formation, the present inventive samples had an oxide film thickness of not more than 40 μm whereas the comparative samples C3, C4, C12 and C13 had oxide film thicknesses of as much as from 84 to 125 μm, in which the shell portion was cooled before forging at a cooling rate lower than the specified range. The oxide film thickness was as much as 190 μm in the comparative sample C5 and C10 in which the heating was performed in air and the rapid cooling of the shell portion before forging was not performed in C5 or performed in C10. In the comparative sample C15 in which the heating was performed at a low rate of 1° C./sec, the forged product has an oxide film thickness as much as 93 μm because of the surface oxide formation during the heating.

It can be also seen from Table 2 that excessive cooling of the shell portion before forging reduces the plastic deformability of the steel material during forging, specifically the comparative sample C14 shows that the enlargement ratio was as small as 1.5 when an 8 mm thick shell portion was rapidly cooled to below 1200° C. before forging.

Table 3 shows the dimensional accuracy of the forged product and the corresponding load maintained at the lower dead point after forging. The steel composition, the heating condition and the forging condition are the same as those used in the present inventive sample S7. The forging was carried out until a maximum load of 10 tonf was reached. A load of 5 to 50% of the maximum load was maintained after the forging. The maintenance of the load was terminated when the sample surface temperature reached the temperatures shown. Ten samples were processed under each condition and the axial height of the forged product was measured. The dimensional accuracy of the forged product was evaluated in terms of a maximum dispersion between the maximum and minimum values of the measured heights, Hb.

Table 4 shows the dimensional accuracy of the forged product and the corresponding condition of the rapid cooling after forging. All of the samples shown were forged under the same condition as that used in the inventive sample S7 with a maximum applied load of 10 tonf and were water-cooled to the surface temperatures shown. The axial heights of the cooled samples were determined.

The cooling parameters were controlled based on the relationship preliminarily established between the water flow rate, the cooling duration term and the surface temperature by an experiment including heating a dummy piece having a thermocouple mounted on the surface thereof to a temperature at which the forging is completed and then cooling the dummy piece at different water flow rates and cooling duration terms. The values of the thus-determined cooling rate and surface temperature are recited in Table 4. Ten samples were processed under each condition and the dimensional accuracy of the forged product was evaluated in terms of the maximum dispersion, Hb, as in Table 3.

For comparison, Tables 3 and 4 also include the data for the present inventive sample S7, in which the load maintenance and rapid cooling were not carried out after forging.

It can be clearly seen from Tables 3 and 4 that, according to the preferred embodiment of the present invention, both the load maintenance and rapid cooling after forging further improve the dimensional accuracy of the forged product, i.e., provide an accuracy of less than 0.35 mm in terms of the maximum dispersion, Hb.

EXAMPLE 2

A comparative steel "D" having the chemical composition stated in Table 5 was forged in the same process sequence as used in the present inventive sample S1. The forged product had an impact value as low as 0.5 kgf-m/cm$^2$ and therefore was not applicable to machine parts.

EXAMPLE 3

Experiments were carried out by using the steel samples A, B and C having the chemical compositions as stated in Table 6 both in a process according to the second aspect of the present invention and in a comparative process. Table 6 also shows the measured values of the solidus and liquidus temperatures of the sample steels. Steels A and B are the same as those listed in Table 1.

30 mm in dia., 45 mm long steel samples were heated to and held at selected temperatures and forged by longitudinal compression at different working speeds with no lubrication. In a process according to the present invention, the samples were heated at different heating rates of from 3° to 20° C./sec by using a high frequency power supply in a nitrogen gas atmosphere.

To preliminarily determine the heating parameters necessary to ensure the desired differential heating, including the induction power and the flow rate of the nitrogen gas blown onto the sample surface, an experimental heating was performed by using a dummy sample with thermocouples embedded therein to a depth of 1 mm and in the middle. The measured temperatures are cited in Table 7 as "Heating temperatures". The dummy samples were only used for this purpose and was not forged.

The real samples to be actually forged did not have thermocouple and were heated with the thus-predetermined heating parameters in accordance with the desired shell and core temperatures to be established.

In the comparative process, some samples were heated in air at a heating rate within the range of from 2° to 20° C./sec, and in this case, the sample temperatures were represented by the core temperature.

In both the inventive and comparative processes, the samples were forged by compression in the direction of the sample axis until a maximum load of 10 tonf was reached. The symbol "α" denotes the area enlargement ratio as previously defined herein with reference to Table 2.

It is demonstrated by the results that the present inventive process ensures a remarkably improved formability, specifically all of the present inventive samples had an enlargement ratio greater than 2.5 whereas all of the comparative samples had poor values less than 2.5 under the same applied load. The formability (α) increases with the increase in working speed from 300 mm/sec through 500 mm/sec to 1000 mm/sec. Comparison between the present inventive samples S102, S104 and Slll also demonstrates that, when the forging die is preheated 10° to 200° C. or higher, an area enlargement ratio α greater than 2.5 can be ensured by using a working speed of 200 mm/sec or more.

Table 8 shows the data regarding the surface oxide formation. It can be seen from Table 8 that the present inventive sample S103 had an oxide film thickness as small as 23 μm whereas the comparative sample Clll had an oxide film thickness of as much as from 122 μm, the latter having been heated at a rate as low as 1° C./sec. The oxide film thickness was as much as 230 μm in the comparative sample C112 in which the heating was performed in air although the heating rate was 5° C./sec, which is within the specified range of the present invention.

Table 9 shows the dimensional accuracy of the forged product and the corresponding load maintained at the dead point after forging. The steel composition, the heating condition and the forging condition are the same as those used in the present inventive sample S105. The forging was carried out until a maximum load of 10 tonf was reached. A load of 5 to 50% of the maximum load was maintained after the forging. The maintenance of the load was terminated when the sample surface temperature reached the shown temperatures. Ten samples were processed under each condition and the axial height of the forged product was measured. The dimensional accuracy of the forged product was evaluated in terms of the maximum dispersion between the maximum and minimum values of the measured heights, Hb.

Table 10 shows the dimensional accuracy of the forged product and the corresponding condition of the rapid cooling after forging. All of the samples shown were forged under the same condition as that used in the inventive sample S105 with a maximum applied load of 10 tonf and was water-cooled to the surface temperatures shown. The axial heights of the cooled samples were determined.

The cooling parameters were controlled based on the relationship preliminarily established between the water flow rate, the cooling duration term and the surface temperature by an experiment including heating a dummy piece having a thermocouple mounted on the surface thereof to a temperature at which the forging is completed and then cooling the dummy piece at different water flow rates and cooling duration terms. The values of the thus-determined cooling rate and surface temperature are recited in Table 10. Ten samples were processed under each condition and the dimensional accuracy of the forged product was evaluated in terms of the maximum dispersion, Hb, as in Table 9.

For comparison, Tables 9 and 10 also include the data for the present inventive sample S105, in which the load maintenance and rapid cooling were not carried out after forging.

It can be clearly seen from Tables 9 and 10 that, according to the preferred embodiment of the present invention, both the load maintenance and rapid cooling after forging further improve the dimensional accuracy of the forged product, i.e., provide an accuracy of less than 0.3 mm in terms of the maximum dispersion, Hb, which is about half the accuracy obtained by the comparative process.

EXAMPLE 4

An experiment was carried out to demonstrate the advantage of the present inventive differential heating of the shell and core portions over the conventional even heating of the entire section.

Table 11 compares the maximum loads used to forge a 100 mm in dia., 100 mm long bar of steel A in a process according to the present invention and in a conventional process, respectively.

The sample bars had thermocouple embedded therein to a depth of 5 mm from the circumferential surface thereof and in the middle of the cross section, respectively.

The samples, together with the thermocouple, were forged by compression in the longitudinal direction until the length was reduced to 50 mm, during which the maximum load required was measured. The other process conditions were the same as those used in the present inventive sample S101.

It can be seen from Table 11 that the present inventive process (sample S120) enables the forging load to be reduced to about 40% of that required in the conventional forging (sample C118) which uses an even heating over the entire cross section, so that the forging equipment can be reduced in size and the forging tool life can be elongated.

TABLE 1

| Steel | Chemical compostion (wt %) C | Si | Mn | P | S | Solidus (°C.) | Liquidus (°C.) |
|---|---|---|---|---|---|---|---|
| A | 0.28 | 0.24 | 0.32 | 0.018 | 0.016 | 1409 | 1510 |
| B | 0.48 | 0.22 | 0.76 | 0.012 | 0.018 | 1396 | 1492 |

TABLE 3

| Sample No. (*1) | Working speed (mm/sec) | Die preheat (°C.) | Load maintained (tonf) | Load maintained (%)(*2) | Surface temp.(*3) (°C.) | Hb (mm) |
|---|---|---|---|---|---|---|
| S15 | 200 | 200 | 5 | 50 | 1000 | 0.30 |
| S16 | 500 | 150 | 5 | 50 | 1000 | 0.26 |
| S17 | 200 | 200 | 1 | 10 | 600 | 0.22 |
| S18 | 500 | 150 | 1 | 10 | 600 | 0.23 |
| C16 | 500 | 150 | 3 | 30 | 1100 | 0.77 |
| C17 | 500 | 150 | 0.5 | 5 | 600 | 0.57 |
| S7 | 500 | 150 | — | — | — | 0.94 |

Note
*1)S: present invention, C: comparison.
*2)%: percentage of load maintained relative to maximum load applied during forging.
*3)surface temperature of the forged product at which the load maintenance was terminated.

TABLE 2

| (*1) Sample No. | Steel | Heating rate (°C./sec) | Atmosphere | Heating temp. (°C.) Shell | Heating temp. (°C.) Core | Working speed (mm/sec) | Die preheat (°C.) | α | Anteforge shell Cooling rate (°C./sec) | Anteforge shell Thickness (mm) | Impact value (kgf-m/cm²) | Thickness of surface oxide (μm) |
|---|---|---|---|---|---|---|---|---|---|---|---|---|
| S1 | A | 3 | Nitrogen | 1370 | 1490 | 500 | 150 | 2.6 | 12 | 4 | 14.1 | 23 |
| S2 | A | 3 | Nitrogen | 1370 | 1490 | 300 | 250 | 2.7 | 12 | 4 | 13.8 | 34 |
| S3 | A | 3 | Nitrogen | 1370 | 1490 | 500 | 200 | 2.5 | 10 | 5 | 12.2 | 27 |
| S4 | A | 20 | Nitrogen | 1480 | 1520 | 500 | 150 | 2.9 | 25 | 6 | 15.2 | 21 |
| S5 | A | 10 | Nitrogen | 1480 | 1520 | 500 | 150 | 2.8 | 20 | 2 | 12.1 | 28 |
| S6 | A | 5 | Nitrogen | 1480 | 1520 | 200 | 200 | 2.6 | 12 | 5 | 14.6 | 34 |

TABLE 2-continued

| (*1) Sample No. | Steel | Heating rate (°C./sec) | Atmosphere | Heating temp. (°C.) Shell | Heating temp. (°C.) Core | Working speed (mm/sec) | Die preheat (°C.) | α | Anteforge shell Cooling rate (°C./sec) | Anteforge shell Thickness (mm) | Impact value (kgf-m/cm²) | Thickness of surface oxide (μm) |
|---|---|---|---|---|---|---|---|---|---|---|---|---|
| C1 | A | 3 | Nitrogen | 1370 | 1490 | 500 | 150 | 2.7 | 10 | 0.5 | 3.7 | 31 |
| C2 | A | 3 | Nitrogen | 1370 | 1490 | 500 | 200 | 2.8 | — | — | 2.6 | 21 |
| C3 | A | 5 | Nitrogen | 1480 | 1520 | 500 | 150 | 2.7 | 5 | 0.6 | 4.2 | 84 |
| C4 | A | 3 | Nitrogen | 1370 | 1490 | 500 | 150 | 2.7 | 2 | 3 | 12.6 | 124 |
| C5 | A | 2 | Air | — | 1230 | 500 | 150 | 1.5 | — | — | 2.5 | 241 |
| C6 | A | 5 | Nitrogen | 1480 | 1520 | 300 | 50 | 1.6 | 20 | 4 | 13.5 | 33 |
| C7 | A | 5 | Nitrogen | 1480 | 1520 | 100 | 200 | 1.8 | 12 | 0.2 | 2.6 | 25 |
| S7 | B | 3 | Nitrogen | 1440 | 1510 | 500 | 150 | 2.5 | 10 | 6 | 11.3 | 27 |
| S8 | B | 5 | Nitrogen | 1440 | 1510 | 500 | 150 | 2.6 | 20 | 2 | 10.6 | 31 |
| S9 | B | 20 | Nitrogen | 1352 | 1480 | 500 | 150 | 2.6 | 15 | 6 | 12.4 | 25 |
| S10 | B | 5 | Nitrogen | 1430 | 1500 | 1000 | 150 | 3.1 | 10 | 6 | 10.9 | 30 |
| S11 | B | 10 | Nitrogen | 1370 | 1500 | 1000 | 150 | 2.9 | 10 | 1 | 10.3 | 22 |
| S12 | B | 20 | Nitrogen | 1430 | 1500 | 200 | 200 | 2.7 | 15 | 6 | 11.2 | 34 |
| S13 | B | 5 | Nitrogen | 1440 | 1510 | 500 | 150 | 2.8 | 25 | 4 | 11.4 | 19 |
| S14 | B | 5 | Nitrogen | 1440 | 1510 | 500 | 300 | 2.8 | 12 | 5 | 12.3 | 21 |
| C8 | B | 5 | Nitrogen | 1440 | 1510 | 500 | 150 | 2.6 | 12 | 0.4 | 2.1 | 33 |
| C9 | B | 5 | Nitrogen | 1260 | 1450 | 500 | 150 | 2.0 | 25 | 5 | 11.7 | 28 |
| C10 | B | 2 | Air | — | 1240 | 500 | 150 | 1.7 | 15 | 4 | 10.2 | 198 |
| C11 | B | 20 | Nitrogen | 1470 | 1500 | 300 | 100 | 2.1 | — | — | 0.9 | 21 |
| C12 | B | 2 | Air | — | 1300 | 300 | 150 | 1.2 | 5 | 4 | 10.7 | 97 |
| C13 | B | 5 | Nitrogen | 1430 | 1500 | 200 | 200 | 2.6 | 2 | 0.5 | 1.1 | 125 |
| C14 | B | 5 | Nitrogen | 1430 | 1500 | 200 | 200 | 1.5 | 12 | 8 | 13.1 | 24 |
| C15 | B | 1 | Nitrogen | 1430 | 1500 | 200 | 200 | 2.7 | 10 | 5 | 10.2 | 93 |

Note *1)S: present invention, C: comparison.

TABLE 4

| Sample No. (*1) | Working speed (mm/sec) | Die preheat (°C.) | Cooling rate after forging (°C./sec) | Surface temp.(*2) (°C.) | Hb (mm) |
|---|---|---|---|---|---|
| S16 | 200 | 200 | 10 | 800 | 0.23 |
| S17 | 500 | 150 | 10 | 800 | 0.21 |
| S18 | 200 | 200 | 5 | 600 | 0.31 |
| S19 | 500 | 150 | 5 | 600 | 0.27 |
| S7 | 500 | 150 | — | — | 0.94 |
| C19 | 500 | 150 | 1 | 600 | 0.67 |
| C20 | 500 | 150 | 10 | 1100 | 0.79 |

Note
*1)S: present invention, C: comparison
*2)surface temperature of the forged product at which the cooling after forging was terminated.

TABLE 5

| Steel | Chemical composition (wt %) C | Si | Mn | P | S | Solidus (°C.) | Liquidus (°C.) |
|---|---|---|---|---|---|---|---|

TABLE 5-continued

| | | | | | | | |
|---|---|---|---|---|---|---|---|
| D | 1.60 | 0.28 | 0.82 | 0.011 | 0.021 | 1250 | 1420 |

TABLE 6

| Steel | Chemical composition (wt %) C | Si | Mn | P | S | Solidus (°C.) | Liquidus (°C.) |
|---|---|---|---|---|---|---|---|
| A | 0.28 | 0.24 | 0.32 | 0.018 | 0.016 | 1409 | 1510 |
| B | 0.48 | 0.22 | 0.76 | 0.012 | 0.018 | 1396 | 1492 |
| C | 0.82 | 0.27 | 0.54 | 0.011 | 0.010 | 1308 | 1467 |

TABLE 7

| (*1) Sample No. | Steel | Heating rate (°C./sec) | Atmosphere | Heating temp. (°C.) Shell | Heating temp. (°C.) Core | Working speed (mm/sec) | Die preheat (°C.) | α |
|---|---|---|---|---|---|---|---|---|
| S101 | A | 3 | Nitrogen | 1370 | 1490 | 500 | 150 | 2.6 |
| S102 | A | 3 | Nitrogen | 1370 | 1490 | 500 | 200 | 2.8 |
| S103 | A | 5 | Nitrogen | 1480 | 1520 | 500 | 150 | 2.9 |
| S104 | A | 3 | Nitrogen | 1480 | 1520 | 200 | 200 | 2.6 |
| C101 | A | 3 | Nitrogen | 1370 | 1430 | 500 | 150 | 1.9 |
| C102 | A | 2 | Air | — | 1230 | 500 | 150 | 1.5 |
| C103 | A | 5 | Nitrogen | 1480 | 1520 | 300 | 50 | 1.6 |
| C104 | A | 5 | Nitrogen | 1480 | 1520 | 100 | 200 | 1.8 |
| S105 | B | 5 | Nitrogen | 1440 | 1510 | 500 | 150 | 2.8 |
| S106 | B | 20 | Nitrogen | 1351 | 1480 | 500 | 150 | 2.6 |
| C105 | B | 5 | Nitrogen | 1260 | 1450 | 500 | 150 | 2.0 |
| C106 | B | 2 | Air | — | 1240 | 500 | 150 | 1.7 |
| C107 | B | 20 | Nitrogen | 1470 | 1500 | 300 | 100 | 2.1 |
| C108 | B | 2 | Air | — | 1300 | 300 | 150 | 1.2 |
| S107 | B | 5 | Nitrogen | 1430 | 1500 | 1000 | 150 | 3.1 |
| S108 | B | 10 | Nitrogen | 1370 | 1500 | 1000 | 150 | 2.9 |
| S109 | C | 5 | Nitrogen | 1390 | 1470 | 500 | 150 | 2.8 |
| S110 | C | 5 | Nitrogen | 1340 | 1450 | 500 | 150 | 2.7 |
| S111 | C | 5 | Nitrogen | 1390 | 1470 | 250 | 300 | 2.6 |
| C109 | C | 5 | Nitrogen | 1390 | 1470 | 50 | 50 | 1.5 |
| C110 | C | 2 | Air | — | 1200 | 500 | 150 | 1.6 |

Note *1)S: present invention, C: comparison.

TABLE 8

| (*1) Sample No. | Steel | Heating temp. (°C.) Shell | Core | Heating rate (°C./sec) | Atmosphere | Working speed (mm/sec) | Thickness of surface oxide (μm) |
|---|---|---|---|---|---|---|---|
| S103 | A | 1480 | 1520 | 5 | Nitrogen | 500 | 23 |
| C111 | A | 1480 | 1520 | 1 | Nitrogen | 500 | 122 |
| C112 | A | — | 1480 | 5 | Air | 500 | 230 |

Note *1)S: present invention, C: comparison.

TABLE 9

| Sample No. (*1) | Working speed (mm/sec) | Die preheat (°C.) | Load maintained (tonf) | (%)(*2) | Surface temp.(*3) (°C.) | Hb (mm) |
|---|---|---|---|---|---|---|
| S112 | 200 | 200 | 5 | 50 | 1000 | 0.25 |
| S113 | 500 | 150 | 5 | 50 | 1000 | 0.21 |
| S114 | 200 | 200 | 1 | 10 | 600 | 0.17 |
| S115 | 500 | 150 | 1 | 10 | 600 | 0.18 |
| C113 | 500 | 150 | 3 | 30 | 1100 | 0.72 |
| C114 | 500 | 150 | 0.5 | 5 | 600 | 0.52 |
| S105 | 500 | 150 | — | — | — | 0.89 |

Note
*1)S: present invention, C: comparison.
*2)%: percentage of load maintained relative to maximum load applied during forging.
*3)surface temperature of the forged product at which the load maintenance was terminated.

TABLE 10

| Sample No. (*1) | Working speed (mm/sec) | Die preheat (°C.) | Cooling rate after forging (°C./sec) | Surface temp.(*2) (°C.) | Hb (mm) |
|---|---|---|---|---|---|
| S116 | 200 | 200 | 10 | 800 | 0.18 |
| S117 | 500 | 150 | 10 | 800 | 0.16 |
| S118 | 200 | 200 | 5 | 600 | 0.26 |
| S119 | 500 | 150 | 5 | 600 | 0.22 |
| S105 | 500 | 150 | — | — | 0.89 |
| C116 | 500 | 150 | 1 | 600 | 0.62 |
| C117 | 500 | 150 | 10 | 1100 | 0.74 |

Note
*1)S: present invention, C: comparison
*2)surface temperature of the forged product at which the cooling after forging was terminated.

TABLE 11

| Sample No. | Heating temp. (°C.) Shell | Core | Maximum load (tonf) |
|---|---|---|---|
| S120 | 1370 | 1490 | 63 |
| C118 | 1370 | 1380 | 106 |

We claim:

1. A process of hot forging a steel at an ultrahigh temperature, comprising the steps of:

heating a steel containing 0.1 wt % or more and less than 1 wt % carbon and having a surface, in an atmosphere substantially composed of a non-oxidizing gas, at a heating rate of from 3° to 20° C./sec in terms of a rate of temperature rise in the steel surface, in a differential manner such that a shell portion of the steel, defined by the steel surface and a depth from the steel surface within a range of from 0.5 mm to 1/5 of a maximum diameter of the steel, is heated to a temperature within a range having a lower limit defined by a higher value selected from a temperature 45° C. below a solidus line in an equilibrium phase diagram of the steel and a temperature of 1250° C. and an upper limit defined by a temperature 20° C. below a liquidus line in said diagram while a core portion enclosed by said shell portion is heated to a temperature 20° C. below said liquidus line or higher;

blowing a cooling medium onto the surface of said heated steel thereby removing an oxide film from the steel surface while cooling a shell portion of the steel, defined by the steel surface and a depth from the steel surface within a range of from 1 mm to 1/5 of the maximum diameter of the steel, at a high cooling rate of 10° C./sec or more to a hot forging temperature of 1200° C. or lower; and hot forging said steel, after said blowing, either in a die at a working speed of 500 mm/sec or more or in a die preheated to a temperature of 200° C. or higher at a working speed of 200 mm/sec or more.

2. A process according to claim 1, wherein said heating in said differential manner comprises a heat generation in the steel by means of electromagnetic induction heating and a heat extraction through the steel surface by means of blowing of a non-oxidizing gas onto the steel surface.

3. A process according to claim 1, wherein said steel consists, in wt %, of:

C: 0.1 or more and less than 1.0,
Si: 0.1–1.5,
Mn: 0.15–2.0,
Ni: 3.5 or less,
Cr: 1.5 or less,
Mo: 0.5 or less, and
the balance consisting of iron and unavoidable impurities.

4. A process according to claim 1, which further comprises the step of:

maintaining said forged steel at a lower dead point of a forging stroke under a load of 10% or more of a maximum load applied during said forging until the steel temperature, at least in the steel surface, is lowered to 1000° C. or lower.

5. A process according to claim 1, which further comprises the step of:

rapidly cooling said forged steel at a cooling rate of 5° C./sec or more until the steel, at least in the steel surface, is cooled to 800° C. or lower.

6. A process of hot forging a steel at an ultrahigh temperature, comprising the steps of:

heating a steel containing 0.1 wt % or more and less than 1 wt % carbon and having a surface, in an atmosphere substantially composed of a non-oxidizing gas, at a heating rate of from 3° to 20° C./sec in terms of a rate of temperature rise in the steel surface, in a differential manner such that a shell portion of the steel, defined by the steel surface and a depth from the steel surface within a range of from 0.5 mm to 1/5 of a maximum diameter of the steel, is heated to a temperature within a range having a lower limit defined by a higher value selected from a temperature 45° C. below a solidus line in an equilibrium phase diagram of the steel and a temperature of 1250° C. and an upper limit defined by a temperature 20° C. below a liquidus line in said diagram while a core portion enclosed by said shell portion is heated to a temperature 20° C. below said liquidus line or higher; and hot forging said heated steel either in a die at a working speed of 500 mm/sec or more or in a die preheated to a temperature of 200° C. or higher at a working speed of 200 mm/sec.

7. A process according to claim 6, wherein said heating in said differential manner comprises a heat generation in the steel by means of electromagnetic induction heating and a heat extraction through the steel surface by means of blowing of a non-oxidizing gas onto the steel surface.

8. A process according to claim 6, wherein said steel consists, in wt %, of:

C: 0.1 or more and less than 1.0,
Si: 0.1–1.5,
Mn: 0.15–2.0,
Ni: 3.5 or less,
Cr: 1.5 or less,
Mo: 0.5 or less, and
the balance consisting of iron and unavoidable impurities.

9. A process according to claim 6, which further comprises the step of:

maintaining said forged steel at a lower dead point of a forging stroke under a load of 10% or more of a maximum load applied during said forging until the steel temperature, at least in the steel surface, is lowered to 1000° C. of lower.

10. A process according to claim 6, which further comprises the step of:

rapidly cooling said forged steel at a cooling rate of 5° C./sec or more until the steel, at least in the steel surface, is cooled to 800° C. or lower.

* * * * *